US011001079B2

(12) United States Patent
Tominaga et al.

(10) Patent No.: US 11,001,079 B2
(45) Date of Patent: May 11, 2021

(54) THERMAL PRINTER AND COMPUTER-READABLE STORAGE MEDIUM

(71) Applicant: CASIO COMPUTER CO., LTD., Tokyo (JP)

(72) Inventors: Shumpei Tominaga, Tokyo (JP); Katsuhiko Motoike, Kanagawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/524,652

(22) Filed: Jul. 29, 2019

(65) Prior Publication Data

US 2020/0039237 A1 Feb. 6, 2020

(30) Foreign Application Priority Data

Jul. 31, 2018 (JP) ..... JP2018-144384

(51) Int. Cl.
*B41J 2/355* (2006.01)
*B41J 2/365* (2006.01)
(Continued)

(52) U.S. Cl.
CPC ..... *B41J 2/3558* (2013.01); *B41J 2/315* (2013.01); *B41J 2/365* (2013.01); *B41J 29/38* (2013.01)

(58) Field of Classification Search
CPC . B41J 2/3558; B41J 2/315; B41J 29/38; B41J 2/365
See application file for complete search history.

(56) References Cited

U.S. PATENT DOCUMENTS 4,827,286 A 5/1989 Sukigara et al.
5,376,952 A * 12/1994 Kokubo ..... B41J 2/355 347/172
(Continued)

FOREIGN PATENT DOCUMENTS

JP S61-12379 A 1/1986
JP S63-166558 A 7/1988
(Continued)

OTHER PUBLICATIONS

Japanese Office Action dated Aug. 11, 2020, in a counterpart Japanese patent application No. 2018-144384. (A machine translation (not reviewed for accuracy) attached.).
(Continued)

*Primary Examiner* — Geoffrey S Mruk
(74) *Attorney, Agent, or Firm* — Chen Yoshimura LLP

(57) ABSTRACT

A thermal printer includes a thermal head in which a plurality of heating elements are arranged in a line, and a processor that executes a printing process of energizing the thermal head successively a predetermined number of times so at to print a printing data by causing a predetermined voltage to be applied to the thermal head the predetermined number of times in accordance with and in synchronization with strobe pulses in a strobe signal, a strobe width of each strobe pulse in the strobe signal defining a duration during which the thermal head is being applied with the predetermined voltage, wherein among the strobe pulses for the predetermined number of times of energizing the thermal head, a strobe width of at least one predetermined strobe pulse is set to be always shorter than a strobe width of another predetermined one of the strobe pulses.

10 Claims, 8 Drawing Sheets

(51) Int. Cl.
*B41J 29/38* (2006.01)
*B41J 2/315* (2006.01)

(56) References Cited

U.S. PATENT DOCUMENTS

| | | | |
|---|---|---|---|
| 5,683,189 | A | 11/1997 | Sukigara et al. |
| 2010/0253758 | A1 | 10/2010 | Mito |

FOREIGN PATENT DOCUMENTS

| | | | |
|---|---|---|---|
| JP | H3-61553 | A | 3/1991 |
| JP | H6-127012 | A | 5/1994 |
| JP | H6-152907 | A | 5/1994 |
| JP | H6-166194 | A | 6/1994 |
| JP | H6-312524 | A | 11/1994 |
| JP | 2005-186510 | A | 7/2005 |
| JP | 2008-155563 | A | 7/2008 |
| JP | 2012-210749 | A | 11/2012 |

OTHER PUBLICATIONS

Chinese Office Action dated Aug. 26, 2020, in a counterpart Chinese patent application No. 201910694798.7. (A machine translation (not reviewed for accuracy) attached.).

* cited by examiner

THERMAL PRINTER AND COMPUTER-READABLE STORAGE MEDIUM

BACKGROUND OF THE INVENTION

Technical Field

The present invention relates to a thermal printer capable of high-speed, high-quality printing and to a computer-readable storage medium.

Background Art

Thermal printers are widely used as printers in electronic devices such as electronic registers and handy terminals. This is because thermal printers are small, simple in structure, and inexpensive as well as because thermal printers do not require any maintenance other than replacement of thermal paper (the printing paper) and therefore offer low maintenance costs.

In thermal printers, there are challenges in terms of improving printing speed and achieving high-quality, distortion-free printing without irregularities in printing darkness. For example, assume that the heating elements of a thermal printer are heated for the same time intervals when printing upper dots and lower dots to form characters on thermal paper. In this case, accumulation of heat in the heating elements causes the temperature of the heating elements to rise when printing the lower dots, which produces dots that are larger than the upper dots and results in distorted characters, thereby reducing print quality.

Japanese Patent Application Laid-Open Publication No. 2012-210749, for example, discloses (in paragraph [0030] of the specification) a technology whereby: "in a printer (thermal printer) 8, when a total printing time Tstb(n) calculated on the basis of printing data for one line to be printed is greater than a total excitation time Tdotline(n) obtained by summing individual excitation times for a prescribed number of steps estimated for the line of printing data, the printer controls the total excitation time Tdotline(n) by summing excitation times for steps other than the last step in the prescribed number of steps, with the time difference ΔT between the total printing time Tstb(n) and the total excitation time Tdotline(n) as a reduced-speed period, and also calculates the total excitation time Tdotline(n) estimated for the next line of printing data on the basis of the excitation time for that last step. As a result, even when the total printing time taken to print a given line exceeds the total excitation time required for a stepping motor to perform one line's worth of feeding (speed increase-required period), the optimal reduced-speed control can be achieved by increasing speed when printing the next line, thereby making it possible to increase printing speed for the overall printing process."

In the technology disclosed in the patent document above, the total printing time and the total excitation time are calculated for each line of printing, and the excitation time for each step is controlled accordingly. When using a high-performance central processing unit (CPU), this approach can offer increased printing speeds. However, when using a low-cost controller, the processing power of the controller gets mostly consumed by printer control, and processes other than printing can become slower as a result. Moreover, in Patent Document 1, there is no discussion of technologies for improving print quality.

The present invention was made in light of the foregoing, and the problem to be solved by the present invention is to provide a thermal printer capable of high-speed, high-quality printing as well as a computer-readable storage medium.

SUMMARY OF THE INVENTION

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides a thermal printer, including: a thermal head in which a plurality of heating elements are arranged in a line; and a processor configured to execute a printing process of energizing the thermal head successively a predetermined number of times so at to print a printing data by causing a predetermined voltage to be applied to the thermal head the predetermined number of times in accordance with and in synchronization with strobe pulses in a strobe signal, a strobe width of each strobe pulse in the strobe signal defining a duration during which the thermal head is being applied with the predetermined voltage when a corresponding heating element or elements are to be energized in order to print the printing data, wherein among the strobe pulses for the predetermined number of times of energizing the thermal head, a strobe width of at least one predetermined strobe pulse is set to be always shorter than a strobe width of another predetermined one of the strobe pulses.

In another aspect, the present disclosure provides a non-transitory computer-readable storage medium storing a program that instructs a processor in a thermal printer that includes, in addition to the processor, a thermal head in which a plurality of heating elements are arranged in a line, to perform a printing process of energizing the thermal head successively a predetermined number of times so at to print a printing data by causing a predetermined voltage to be applied to the thermal head the predetermined number of times in accordance with and in synchronization with strobe pulses in a strobe signal, a strobe width of each strobe pulse in the strobe signal defining a duration during which the thermal head is being applied with the predetermined voltage when a corresponding heating element or elements are to be energized in order to print the printing data, wherein among the strobe pulses for the predetermined number of times of energizing the thermal head, a strobe width of at least one predetermined strobe pulse is set to be always shorter than a strobe width of another predetermined one of the strobe pulses. It is to be understood that both the foregoing general description and the following detailed description are exemplary and explanatory, and are intended to provide further explanation of the invention as claimed.

DETAILED DESCRIPTION OF EMBODIMENTS

Overall Configuration of Embodiment 1

Next, an electronic register including a thermal printer according to an embodiment of the present invention will be described.

Figure 1:
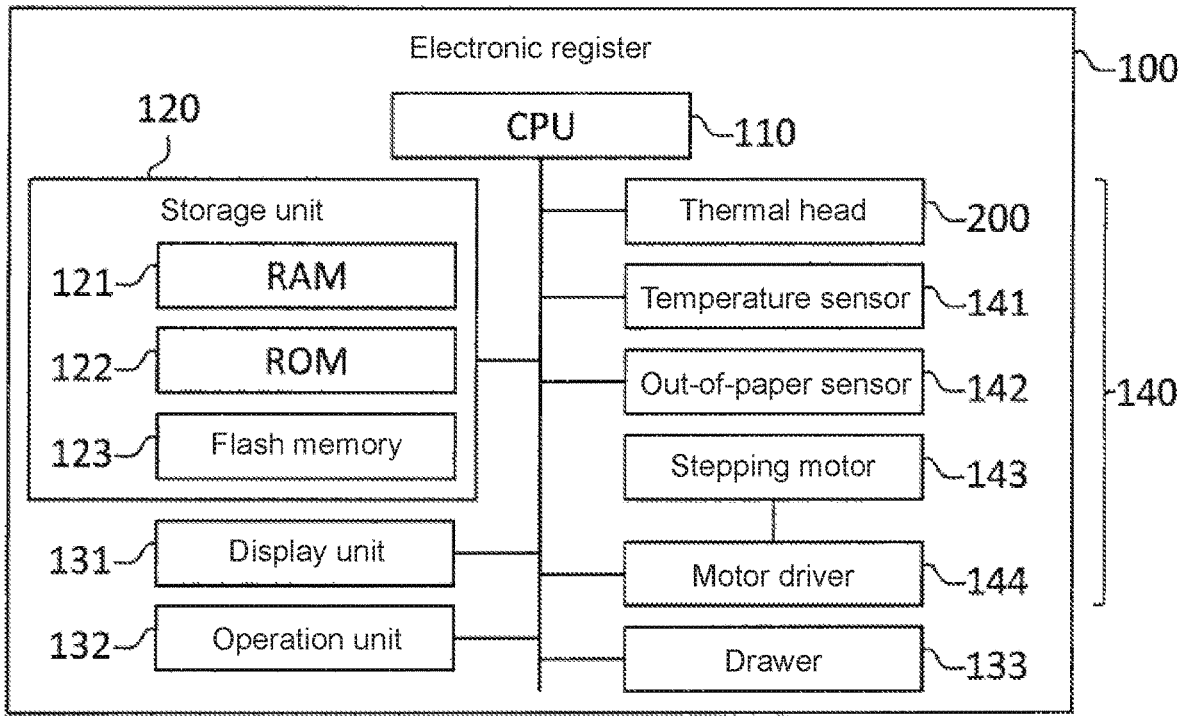
FIG. 1 is an internal block diagram of an electronic register including a thermal printer according to Embodiment 1 of the present invention.
Figure 2:
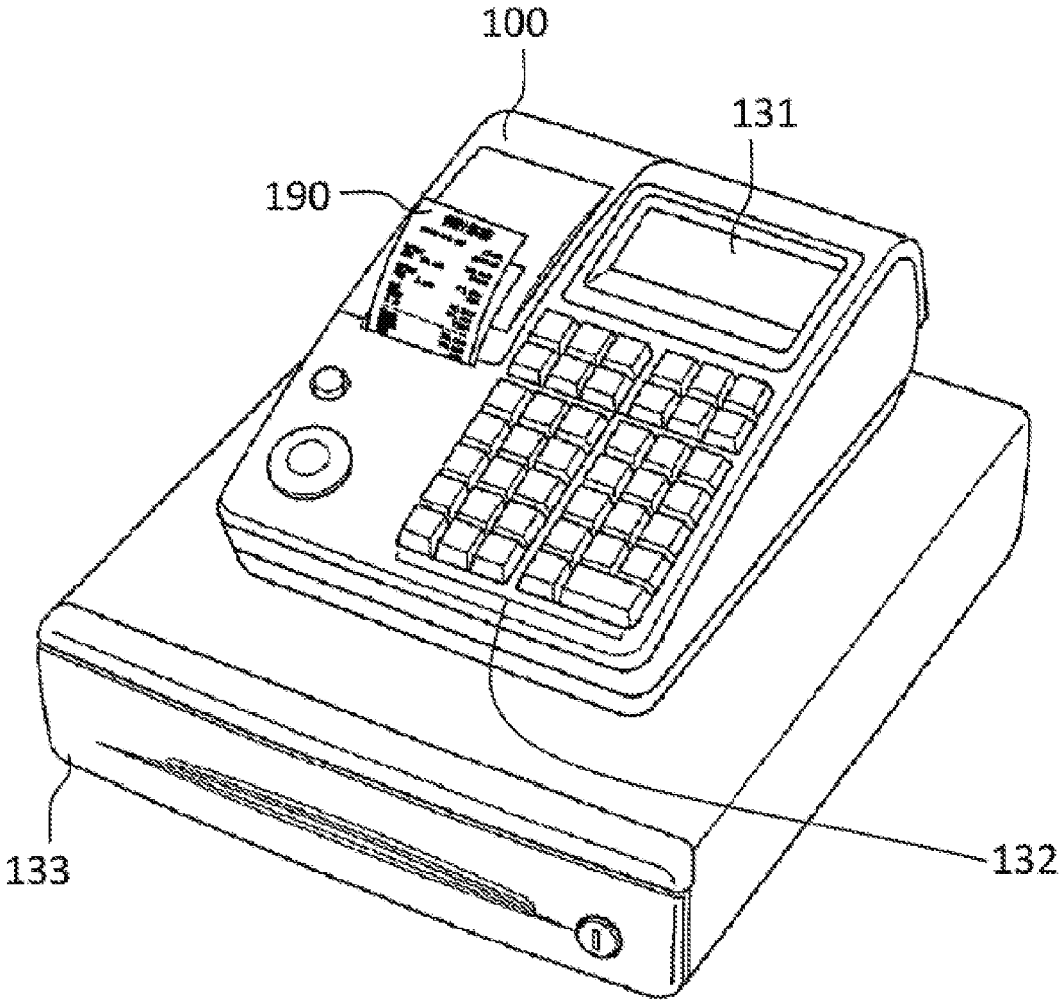
FIG. 2 is an exterior view of the electronic register including the thermal printer according to Embodiment 1.

FIG. 1 is an internal block diagram of an electronic register 100 including a thermal printer 140 according to Embodiment 1. FIG. 2 is an exterior view of the electronic register 100 including the thermal printer 140 according to Embodiment 1. The configuration of thermal printer 140 and the configuration of the electronic register 100 will be described with reference to FIGS. 1 and 2.

The electronic register 100 includes a CPU 110, a storage unit 120, a display unit 131, an operation unit 132, a drawer 133, and the thermal printer 140. The CPU 110 executes programs (not illustrated in the figure) stored on the storage unit 120 to control the thermal printer 140 and operate the electronic register 100.

The storage unit 120 includes a random-access memory (RAM) 121, a read-only memory (ROM), and flash memory 123 or the like and stores programs, data required for the processes of the electronic register 100, and the like.

The display unit 131 displays information such as the names and prices of products registered by an employee, the amounts of money tendered by customers, and the amount of change due. The operation unit 132 is keys for entering products and prices. The drawer 134 is a storage space for physical currency.

<Configuration of Thermal Printer>

The thermal printer 140 is a printer for printing receipts 190 and is built into the chassis of the electronic register 100 beneath the receipt 190 illustrated in FIG. 2. The thermal printer 140 includes a thermal head 200 (see FIG. 3, described later), a temperature sensor 141, an out-of-paper sensor 142, and a stepping motor 143 and motor driver 144 for conveying paper (thermal paper).

Figure 3:
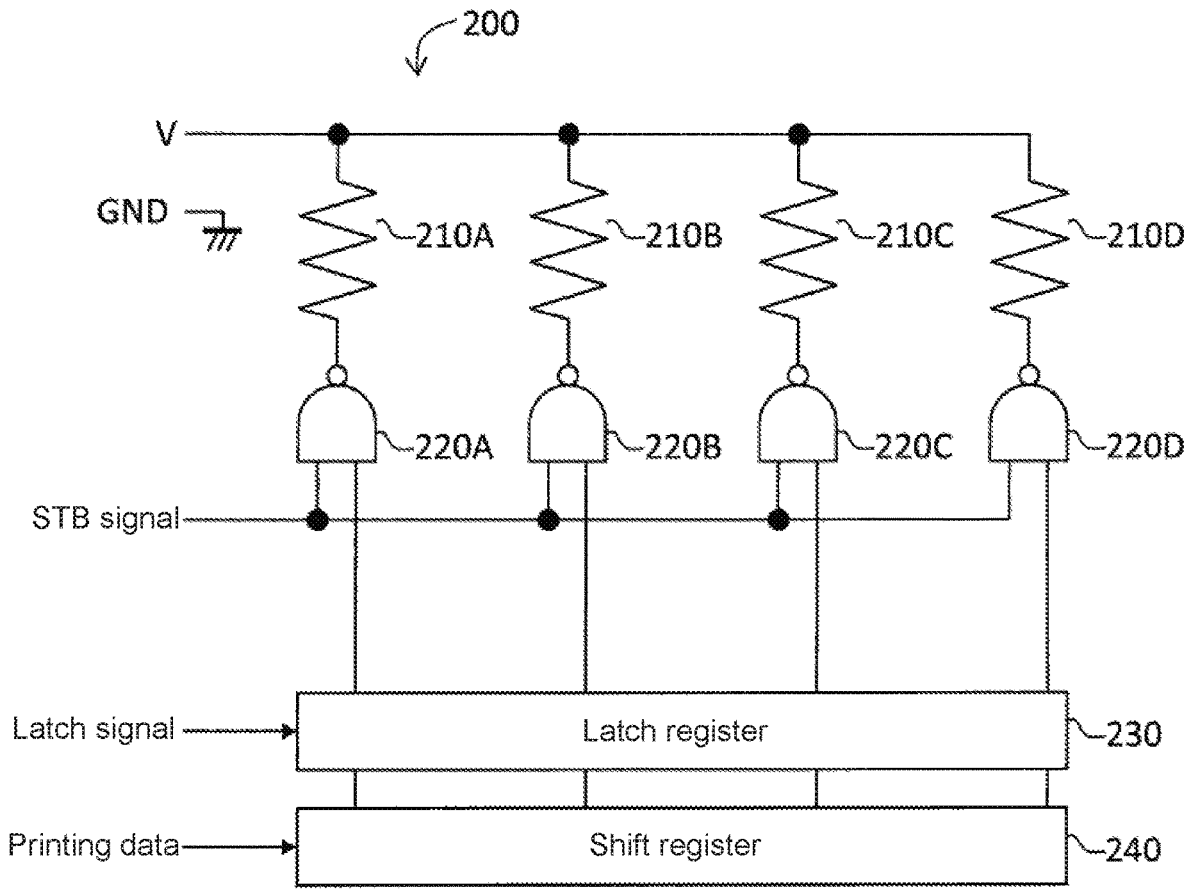
FIG. 3 illustrates the configuration of a thermal head according to Embodiment 1.

FIG. 3 illustrates the configuration of the thermal head 200 according to Embodiment 1. The thermal head 200 includes heating resistors (heating elements) 210A to 210D which form printing dots, NAND gates 220A to 220D, a latch register 230, and a shift register 240. Although FIG. 3 respectively illustrates the four heating resistors 210A to 210D and the four NAND gates 220A to 220D, the numbers of these components are actually equal to the number of dots in the horizontal direction of the paper (the direction orthogonal to the direction in which the stepping motor 143 conveys paper). Below, the heating resistors 210A to 210D will be collectively referred to as heating resistors 210, and the NAND gates 220A to 220D will be collectively referred to as NAND gates 220.

One end of each heating resistor 210 is connected to a voltage application terminal V, and the other end is connected to an output terminal of the respective NAND gate 220, which controls that heating resistor 210. One input terminal of each NAND gate 220 is connected to a strobe signal (indicated by "STB signal" in FIG. 3, and also indicated by "STB signal" in the other figures), and the other input terminal is connected to an output of the latch register 230.

The latch register 230 is connected to the shift register 240 and, when a latch signal is input, stores data in the form of bits corresponding to dots in printing data input to the shift register 240. This printing data is input to the shift register 240 from the CPU 110.

Once printing data for all of the dots in one line (all of the dots aligned in the direction orthogonal to the direction in which the stepping motor 143 conveys paper) has been input to the shift register 240, a latch signal is input to the latch register 230. After the latch signal is input, a strobe signal with a positive logical value is input. This causes the NAND gates 220 to open in accordance with the input of the strobe signal (while the strobe signal is high (ON)), and the heating resistors 210 have the voltage V applied thereto and therefore generate heat and print dots in accordance with the dots in the printing data stored by the latch register 230.

Note that in the following description, the period of time in which the strobe signal is high (ON) and voltage is being applied to the heating resistors 210 (thermal head 200) will also be referred to as an "application period". Moreover, the duration of the period in which the strobe signal is ON (application period) will also be referred to as the "strobe signal width".

Longer strobe signal widths (application periods) increase the amount of heat generated and cause dots to be printed more darkly. If the strobe signal width is too long, the heating resistors 210 generate an excessive amount of heat, which causes each dot to become larger and protrude into regions for other dots, thereby resulting in distorted printing. The same problem also occurs if the heat-generating state of the heating resistors 210 continues.

Returning to FIG. 1, the temperature sensor 141 detects the temperature of the thermal head 200. The out-of-paper sensor 142 detects when the paper (thermal paper) is depleted and needs to be replaced. The stepping motor 143 is a motor which conveys the paper. The motor driver 144 is a circuit for step-driving the stepping motor 143 and takes motor phase signals from the CPU 110 as input.

<Receipt>

Figure 4:
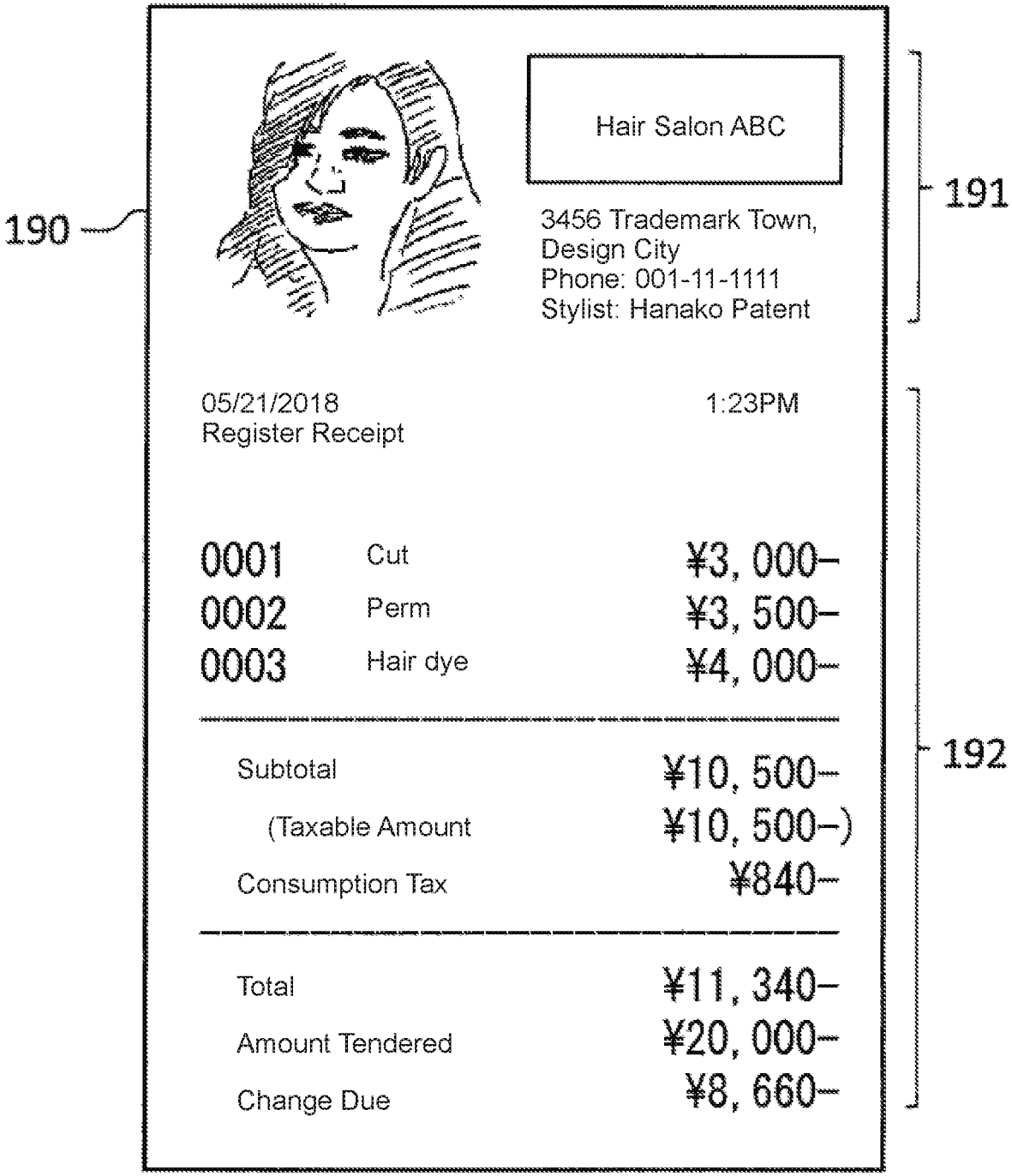
FIG. 4 illustrates a receipt printed by the thermal printer according to Embodiment 1.

FIG. 4 illustrates a receipt 190 printed by the thermal printer according to Embodiment 1. The top portion of the receipt 190 is a graphics data region 191 in which graphics data is printed, and after this, a character data region 192 is printed. Below, each character printed in the character data region will be described as being constituted by 24×24 dots.

Embodiment 1: Timing of Voltage Application to Thermal Head

Figure 5:
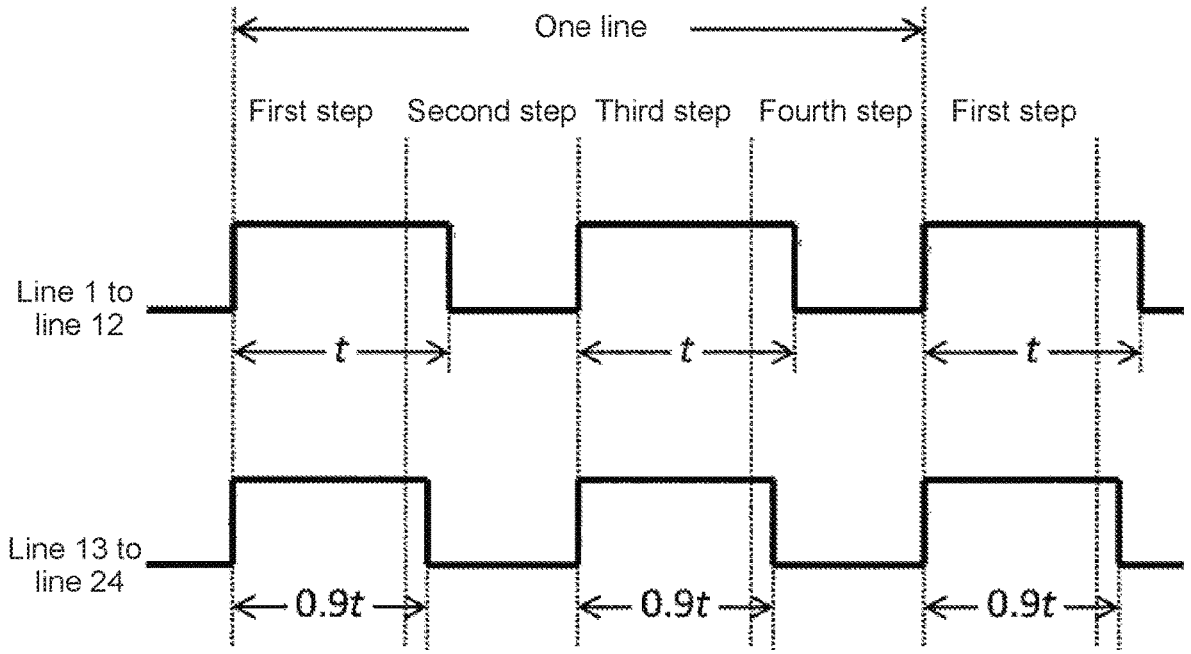
FIG. 5 is a timing chart for explaining a strobe signal in the thermal printer according to Embodiment 1.

FIG. 5 is a timing chart for explaining the strobe signal in the thermal printer 140 according to Embodiment 1. The four steps (first step to fourth step) listed at the top of FIG. 5 represent steps over which the stepping motor 143 conveys one dot's worth of paper. In the four-step process starting from the first step, the stepping motor 143 conveys one dot's worth of paper. The CPU 110 controls the strobe signal (turns the strobe signal ON) such that voltage is applied to the thermal head 200 (heating resistors 210) in synchronization with the first step and the third step.

In the character data region 192, letting the strobe signal width for when printing the first 12 dot lines (line 1 to line 12) of dots to form characters be t, the strobe signal width for the remaining 12 dot lines (line 13 to line 24) is set to 0.9 t. Here, t may be set to a prescribed time duration, may be a time duration determined by the CPU 110 on the basis of the temperature of the thermal head 200 detected by the temperature sensor 141, or may be determined from the data to be printed. When the temperature of thermal head 200 becomes equal to a high temperature, the CPU 110 reduces t.

Regarding the relationship between temperature and t, t may be calculated from temperature by using a prescribed formula, or the relationship between temperature and t may be stored in a table stored on the storage unit 120, and t may be determined from temperature by referencing this table.

Moreover, when printing the graphics data region 191, the strobe signal width is constant for each dot line. The strobe signal width for the graphics data region 191 may be the same as the strobe signal width t for the character data region 192 or may be determined separately.

In the description above, the CPU 110 is described as applying voltage to all of the heating resistors 210 in the thermal head 200 at the same time. Alternatively, due to power supply capacity constraints, the heating resistors 210 may be divided into a plurality of blocks and have voltage applied thereto sequentially. In this case, the CPU 110 still controls the strobe signal such that voltage is applied to the respective blocks of heating resistors 210 in synchronization with the first step and the third step (at a prescribed period of time from when the first step begins and at a prescribed period of time from when the third step begins).

Embodiment 1: Strobe Signal Control Process

Figure 6:
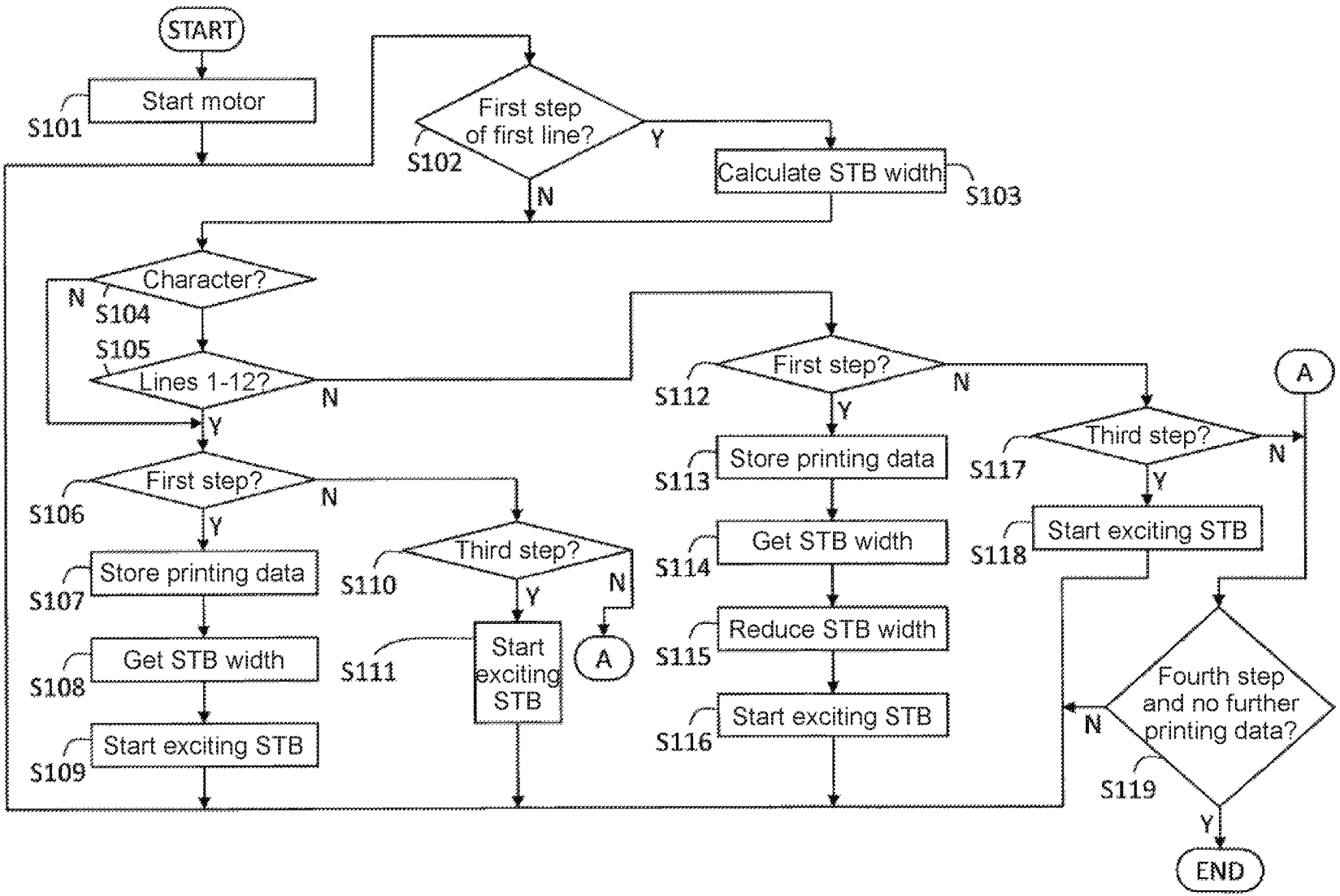
FIG. 6 is a flowchart of a strobe signal control process executed by a CPU in the thermal printer according to Embodiment 1.

FIG. 6 is a flowchart of a strobe signal control process executed by the CPU 110 in the thermal printer according to Embodiment 1. In FIG. 6, steps S102 to S119 form a loop, and each iteration of this loop corresponds to one step of the stepping motor 143. By repeating the loop four times from the first step to the fourth step, one line of dots (one dot line) is printed. Moreover, the appropriate printing data is input to the shift register 240 by the CPU 110, so the description of this process does not touch upon input of printing data to the shift register 240.

In step S101, the CPU 110 starts operation of the stepping motor 143.

In step S102, if the dot line to be printed is the first dot line (line 1) in the graphics data region 191 or is the first dot line (line 1) in a line of text and the current step of the stepping motor 143 is a first step (Y in step S102), the CPU 110 proceeds to step S103. Otherwise (N in step S102), the CPU 110 proceeds to step S104.

In step S103, the CPU 110 calculates the strobe signal width. More specifically, on the basis of the graphics data or line of text data to be printed, the CPU 110 calculates the strobe signal width to use when printing that data. During this calculation, as described with reference to FIG. 5, the CPU 110 calculates the signal width t on the basis of the temperature of the thermal head 200, the total number of dots in the data to be printed, or the like. Alternatively, the signal width may be a prescribed value.

In step S104, if the printing data is for the character data region 192 (Y in step S104), the CPU 110 proceeds to step S105, while if the printing data is for the graphics data region 191 rather than for the character data region 192 (N in step S104), the CPU 110 proceeds to step S106. In step S105, if the dots to be printed are dots for line 1 to line 12 of the character data (Y in step S105), the CPU 110 proceeds to step S106. Otherwise (N in step S105), the CPU 110 proceeds to step S112.

In step S106, if the current step of the stepping motor 143 is a first step (Y in step S106), the CPU 110 proceeds to step S107, while if the current step is not a first step (N in step S106), the CPU 110 proceeds to step S110.

In step S107, the CPU 110 outputs a latch signal to the latch register 230 to store the printing data.

In step S108, the CPU 110 obtains the strobe signal width calculated in step S103.

In step S109, the CPU 110 inputs a strobe signal that takes the ON state for the strobe signal width obtained in step S108 to the NAND gates 220, and then returns to step S102.

In step S110, if the current step of the stepping motor 143 is a third step (Y in step S110), the CPU 110 proceeds to step S111, while if the current step is not a third step (N in step S110), the CPU 110 proceeds to step S119.

In step S111, the CPU 110 inputs a strobe signal that takes the ON state for the same strobe signal width as in the previous iteration to the NAND gates 220, and then returns to step S102. Step S111 is a process included in printing the dots for line 1 to line 12 (see step S105), and the strobe signal width is the strobe signal width obtained in step S108.

In step S112, if the current step of the stepping motor 143 is a first step (Y in step S112), the CPU 110 proceeds to step S113, while if the current step is not a first step (N in step S112), the CPU 110 proceeds to step S117.

Steps S113 and S114 are the same processes as in steps S107 and S108.

In step S115, the CPU 110 reduces the strobe signal width obtained in step S114. For example, the CPU 110 reduces the strobe signal width by 10% as illustrated in FIG. 5.

In step S116, the CPU 110 inputs a strobe signal that takes the ON state for the reduced strobe signal width obtained in step S115 to the NAND gates 220, and then returns to step S102.

In step S117, if the current step of the stepping motor 143 is a third step (Y in step S117), the CPU 110 proceeds to step S118, while if the current step is not a third step (N in step S117), the CPU 110 proceeds to step S119.

In step S118, the CPU 110 inputs a strobe signal that takes the ON state for the same strobe signal width as in the previous iteration to the NAND gates 220, and then returns to step S102. Step S118 is a process included in printing the dots for line 13 to line 24 (see step S105), and the strobe signal width is the same strobe signal width as in step S116, which is the reduced strobe signal width.

In step S119, if the current step of the stepping motor 143 is a fourth step and there is no further printing data (Y in step S119), the CPU 110 ends the process, while if the current step is not a fourth step or there is further printing data (N in step S119), the CPU 110 returns to step S102.

Characteristics of Embodiment 1

As described with reference to FIGS. 5 and 6, the CPU 110 prints the dots for line 1 to line 12 at first steps and third steps using the strobe signal width (application period) calculated for the first line (see steps S102 and S108), while the CPU 110 prints the dots for line 13 to line 24 using a reduced, shorter strobe signal width (see step S115). By printing in this manner, the CPU 110 prevents irregularities in the sizes of dots in the upper and lower portions of characters due to accumulation of heat in the heating elements, thereby making it possible to improve print quality.

The process for calculating strobe signal width in step S115 simply involves multiplying the strobe signal width obtained in step S114 by a prescribed value. Moreover, this process of reducing the strobe signal width is executed only this one time in step S115 per dot line printed. Therefore, the load on the CPU 110 is low, which makes it possible to print at high quality and high speeds even when using a low-cost CPU.

In the graphics data region 191, the strobe signal width is not reduced. This is to avoid making irregularities in printing darkness which would otherwise result from reducing the strobe signal width at some intermediate dot line within the region more apparent.

Modification Example of Embodiment 1: Calculation of Strobe Signal Width

In the strobe signal control process illustrated in FIG. 6, the CPU 110 calculates the strobe signal width for graphics data or for each line of text data (see steps S102 and S103).

Alternatively, in the character data region 192, the CPU 110 may calculate the strobe signal width each prescribed number of lines of text (on odd-numbered lines, for example) rather than for each line of text. This makes it possible to print at higher speeds.

Moreover, the CPU 110 may calculate strobe signal width on the first step of the first first line (the first dot line in a line of text) encountered after a prescribed period of time since strobe signal width was previously calculated has elapsed.

Modification Example of Embodiment 1: Reduction of Strobe Signal Width

In Embodiment 1, line 13 to line 24 are printed using a strobe signal width that is 10% shorter than that for line 1 to line 12. This value of 10% is merely an example, and other values may be set as appropriate for the thermal head 200.

Modification Example of Embodiment 1: Dot Line Region in which Strobe Signal Width is Changed In Embodiment 1, each character is constituted by 24×24 dots, and the strobe signal width is changed for the upper half of the dot lines and the lower half of the dot lines. However, using three divisions, for example, the strobe signal widths for line 9 to line 16 and line 17 to line 24 may respectively be set to 95% and 90% of the strobe signal width for line 1 to line 8. Moreover, the CPU 110 may set the strobe signal width to be increasingly short for increasingly lower lines (subsequent lines in printing order). Furthermore, the assumption of each character being constituted by 24×24 dots is merely an example, and even with different numbers of dots, the dots may be divided up appropriately and the strobe signal width may be changed according to dot line.

Embodiment 2

In Embodiment 1, the CPU 110 changes strobe signal width between the upper half (first half) and lower half (latter half) of a character. In Embodiment 2, the CPU 110 changes strobe signal width while printing a single dot line.

Embodiment 2: Timing of Application to Thermal Head

Figure 7:
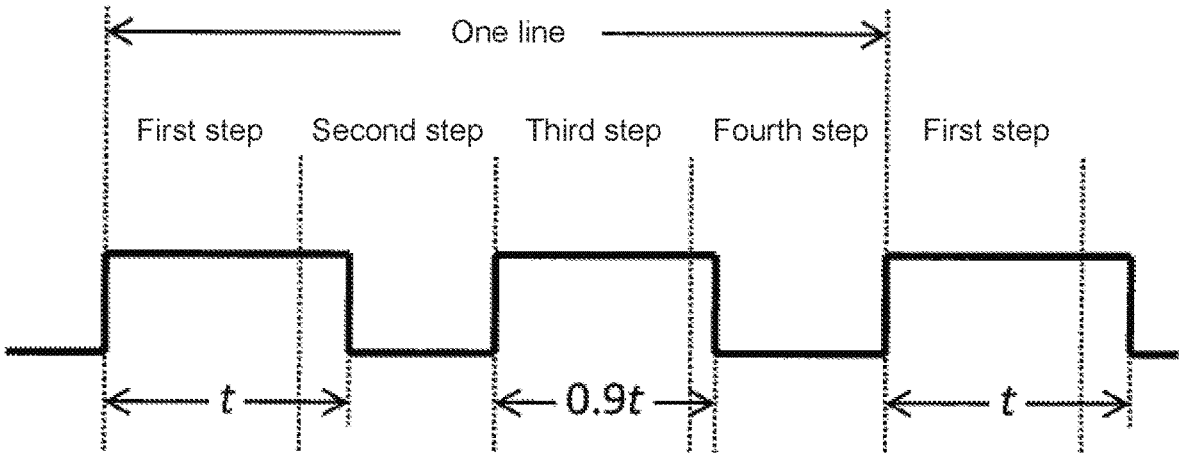
FIG. 7 is a timing chart for explaining a strobe signal in a thermal printer according to Embodiment 2.

FIG. 7 is a timing chart for explaining a strobe signal in a thermal printer 140 according to Embodiment 2. The CPU 110 controls the strobe signal such that voltage is applied to the thermal head 200 (heating resistors 210) in synchronization with the first step and the third step. More specifically, while printing a single dot line, the CPU 110 sets the strobe signal to ON in the first step and the third step of the stepping motor 143, but sets the strobe signal width for the third step shorter than that for the first step. Letting the strobe signal width for the first step be t, for example, the strobe signal width for the third step is set to 0.9 t.

Embodiment 2: Strobe Signal Control Process

Figure 8:
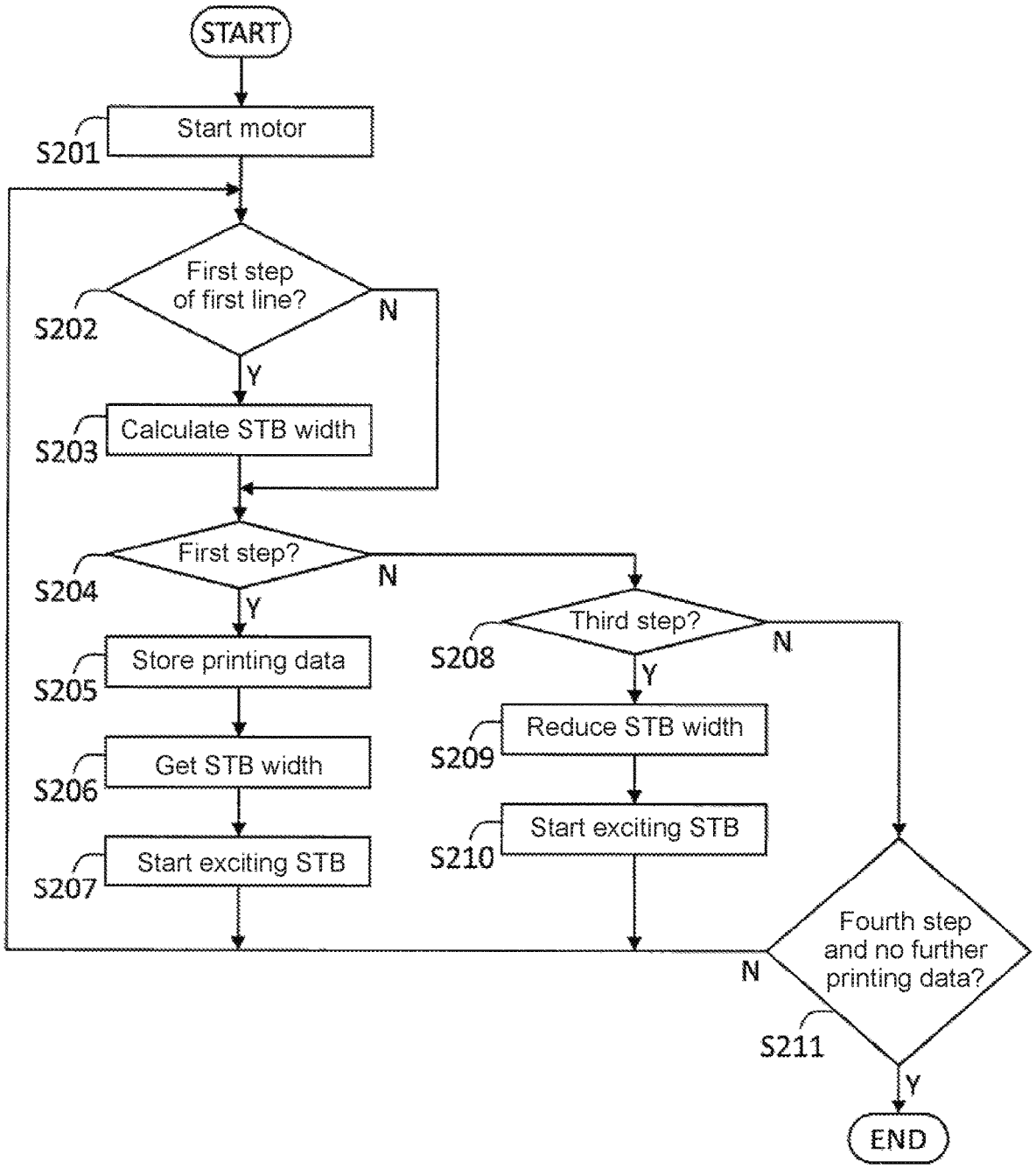
FIG. 8 is a flowchart of a strobe signal control process executed by a CPU in the thermal printer according to Embodiment 2.

FIG. 8 is a flowchart of a strobe signal control process executed by the CPU 110 in the thermal printer according to Embodiment 2. In FIG. 8, steps S202 to S211 form a loop, and each iteration of this loop corresponds to one step of the stepping motor 143. By repeating the loop four times from the first step to the fourth step, one dot line is printed. Moreover, the appropriate printing data is input to the shift register 240 by the CPU 110, so the description of this process does not touch upon input of printing data to the shift register 240.

In step S201, the CPU 110 starts operation of the stepping motor 143.

Steps S202 and S203 are the same processes as in steps S102 and S103 in FIG. 6.

In step S204, if the current step of the stepping motor 143 is a first step (Y in step S204), the CPU 110 proceeds to step S205, while if the current step is not a first step (N in step S204), the CPU 110 proceeds to step S208.

Steps S205 to S207 are the same processes as in steps S107 to S109 in FIG. 6. In step S206, the CPU 110 obtains the strobe signal width calculated in step S203.

In step S208, if the current step of the stepping motor 143 is a third step (Y in step S208), the CPU 110 proceeds to step S209, while if the current step is not a third step (N in step S208), the CPU 110 proceeds to step S211.

In step S209, the CPU 110 reduces the strobe signal width obtained in step S206. For example, the CPU 110 reduces the strobe signal width by 10% as illustrated in FIG. 7.

In step S210, the CPU 110 inputs a strobe signal that takes the ON state for the reduced strobe signal width obtained in step S209 to the NAND gates 220, and then returns to step S202.

In step S211, if the current step of the stepping motor 143 is a fourth step and there is no further printing data (Y in step S211), the CPU 110 ends the process, while if the current step is not a fourth step or there is further printing data (N in step S211), the CPU 110 returns to step S202.

Characteristics of Embodiment 2

As described with reference to FIGS. 7 and 8, while printing a single dot line, the CPU 110 reduces the strobe signal width for the third step so as to be shorter than the strobe signal width for the first step. By printing in this manner, the CPU 110 prevents irregularities in the sizes of dots in the upper and lower portions of characters due to accumulation of heat in the heating elements, thereby making it possible to improve print quality.

Moreover, the process for calculating the strobe signal width for the third step simply involves multiplying the strobe signal width for a first step by a prescribed value. Therefore, the load on the CPU 110 is low, which makes it possible to print at high quality and high speeds even when using a low-cost CPU.

Modification Example of Embodiment 2: Number of Stepping Motor Steps

In Embodiment 2, over the four steps from the first step to the fourth step, the stepping motor 143 conveys one dot's worth of paper. However, the number of steps is not limited to four steps. For example, the stepping motor 143 may convey one dot's worth of paper over six steps, in which case the strobe signal width for the fourth step may be set to 90% of the strobe signal width for the first step. Moreover, the strobe signal widths for the third step and the fifth step may respectively be set to 95% and 90% of the strobe signal width for the first step. The signal width may also be shortened with each subsequent step. Furthermore, for the dot lines (24 dot lines) that form a line of text, the CPU 110 may calculate the strobe signal width for each dot line. This type of control makes it possible to achieve high-quality printing with no irregularities in printing darkness.

Modification Examples

Furthermore, as another modification example, in the strobe signal widths for the graphics data region 191, the character data region 192, or another region of a prescribed number of lines of text, a subset of the strobe signal widths may be set shorter than the other strobe signal widths. In addition, subsequent strobe signal widths may be set to never be longer than previous strobe signal widths.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A thermal printer, comprising:

a thermal head in which a plurality of heating elements are arranged in a line;

a processor configured to execute a printing process of energizing the thermal head successively a predetermined number of times so at to print a printing data by causing a predetermined voltage to be applied to the thermal head the predetermined number of times in accordance with and in synchronization with strobe pulses in a strobe signal, a strobe width of each strobe pulse in the strobe signal defining a duration during which the thermal head is being applied with the predetermined voltage when a corresponding heating element or elements are to be energized in order to print the printing data; and a stepping motor that conveys a thermal paper, wherein among the strobe pulses for the predetermined number of times of energizing the thermal head, a strobe width of at least one predetermined strobe pulse is set to be always shorter than a strobe width of another predetermined one of the strobe pulses, wherein the printing data is printing data for text, and the text includes a prescribed number of dots arranged in a direction in which the stepping motor conveys the thermal paper, and wherein said printing process of energizing the thermal head successively a predetermined number of times is a process of printing said prescribed number of dots of the text, and the strobe width of strobe pulses for printing a subset of the prescribed number of dots of the text is set to be always shorter than the strobe width of strobe pulses for printing a remaining subset of the prescribed number of dots.

2. The thermal printer according to claim 1, wherein the at least one predetermined strobe pulse occurs at a time later than a time at which the another predetermined one of the strobe pulses occurs.

3. The thermal printer according to claim 1, wherein the subset of the prescribed number of dots for which the strobe width is set shorter is a latter half of the dots, and the remaining subset of the prescribed number of dots is a first half of the dots.

4. The thermal printer according to claim 3, wherein the processor determines the strobe width for printing the first half of the dots on the basis of the printing data for the text.

5. The thermal printer according to claim 1, wherein with said prescribed number of dots of the text, the strobe width of a strobe pulse in the strobe signal for printing a dot that is being printed later than another dot is equal to or shorter than the strobe width of a strobe pulse for printing said another dot.

6. A computer-readable storage medium storing a program that instructs a processor in a thermal printer that includes, in addition to the processor, a thermal head in which a plurality of heating elements are arranged in a line, to perform a printing process of energizing the thermal head successively a predetermined number of times so at to print a printing data by causing a predetermined voltage to be applied to the thermal head the predetermined number of times in accordance with and in synchronization with strobe pulses in a strobe signal, a strobe width of each strobe pulse in the strobe signal defining a duration during which the thermal head is being applied with the predetermined voltage when a corresponding heating element or elements are to be energized in order to print the printing data, wherein among the strobe pulses for the predetermined number of times of energizing the thermal head, a strobe width of at least one predetermined strobe pulse is set to be always shorter than a strobe width of another predetermined one of the strobe pulses, wherein the thermal printer further includes a stepping motor that conveys a thermal paper, wherein the printing data is printing data for text, and the text includes a prescribed number of dots arranged in a direction in which the stepping motor conveys the thermal paper, and wherein said printing process of energizing the thermal head successively a predetermined number of times is a process of printing said prescribed number of dots of the text, and the strobe width of strobe pulses for printing a subset of the prescribed number of dots of the text is set to be always shorter than the strobe width of strobe pulses for printing a remaining subset of the prescribed number of dots.

7. The computer-readable storage medium according to claim 6, wherein the at least one predetermined pulses occurs at a time later than a time at which the another predetermined one of the strobe pulses occurs.

8. The computer-readable storage medium according to claim 6, wherein the subset of the prescribed number of dots for which the strobe width is set shorter is a latter half of the dots, and the remaining subset of the prescribed number of dots is a first half of the dots.

9. The computer-readable storage medium according to claim 8, wherein the program instructs the processor to determine the strobe width for printing the first half of the dots on the basis of the printing data for the text.

10. The thermal printer according to claim 6, wherein with said prescribed number of dots of the text, the strobe width of a strobe pulse in the strobe signal for printing a dot that is being printed later than another dot is equal to or shorter than the strobe width of a strobe pulse for printing said another dot.

* * * * *